United States Patent [19]

Yoshioka et al.

[11] 4,016,838

[45] Apr. 12, 1977

[54] APPARATUS FOR OPENING AND CLOSING CONTROL OF A MULTI-CARBURETOR ARRANGEMENT

[75] Inventors: Yuichi Yoshioka, Asaka; Tsugio Sanka, Wako, both of Japan

[73] Assignees: Honda Giken Kogyo Kabushiki Kaisha; Kabushiki Kaisha Keihin Seiki Seisakusho, both of Tokyo, Japan

[22] Filed: Feb. 18, 1976

[21] Appl. No.: 658,993

[30] Foreign Application Priority Data

Feb. 20, 1975 Japan ..... 50-22506[U]

[52] U.S. Cl. ..... 123/59 PC; 123/127; 261/44 R; 74/471 R

[51] Int. Cl.[2] ..... F02M 13/04

[58] Field of Search ..... 123/59 PC, 127; 261/23 A, 44 R; 74/471 R

[56] References Cited

UNITED STATES PATENTS

| | | | |
|---|---|---|---|
| 2,128,006 | 8/1938 | Maniscalco | 123/127 |
| 2,323,442 | 7/1943 | Beard | 123/59 PC |
| 2,761,437 | 9/1956 | Stolte | 123/59 PC |
| 2,811,862 | 11/1957 | Libby | 123/59 PC |
| 3,030,819 | 4/1962 | Edelbrock, Jr. | 123/59 PC |
| 3,742,922 | 7/1973 | Hisatomi | 123/59 PC |

FOREIGN PATENTS OR APPLICATIONS

| | | | |
|---|---|---|---|
| 2,150,166 | 4/1972 | Germany | 123/59 PC |

*Primary Examiner*—Carlton R. Croyle
*Assistant Examiner*—Leonard Smith
*Attorney, Agent, or Firm*—Haseltine, Lake & Waters

[57] ABSTRACT

An apparatus for the opening and closing control of a multicarburetor arrangement in which throttle valves of a plurality of carburetors are controlled to be opened and closed by a single common throttle valve operation member. A single drum shaft is inserted through respective carburetor casings and is connected by respective throttle shafts to the throttle valves. The drum shaft is rotatably supported in two bearings in two carburetor casings and the drum shaft is driven in rotation by the common operation member.

9 Claims, 3 Drawing Figures

APPARATUS FOR OPENING AND CLOSING CONTROL OF A MULTI-CARBURETOR ARRANGEMENT

This invention relates to an apparatus for the opening and closing control of a multiple carburetor arrangement of the type in which a plurality of carburetors equal in number to the cylinders in a multi-cylinder internal combustion engine are provided side by side and these carburetors are controlled to open and close in a gang-coupled relationship. This invention has for its object to provide such an apparatus wherein a drum shaft comprising a single common shaft for controlling the opening and closing of throttle valves of respective carburetors through links, throttle levers and throttle shafts can be easily mounted and an accordance mechanism for throttle valve open degrees of respective carburetors can be easily operated.

Figure 1:
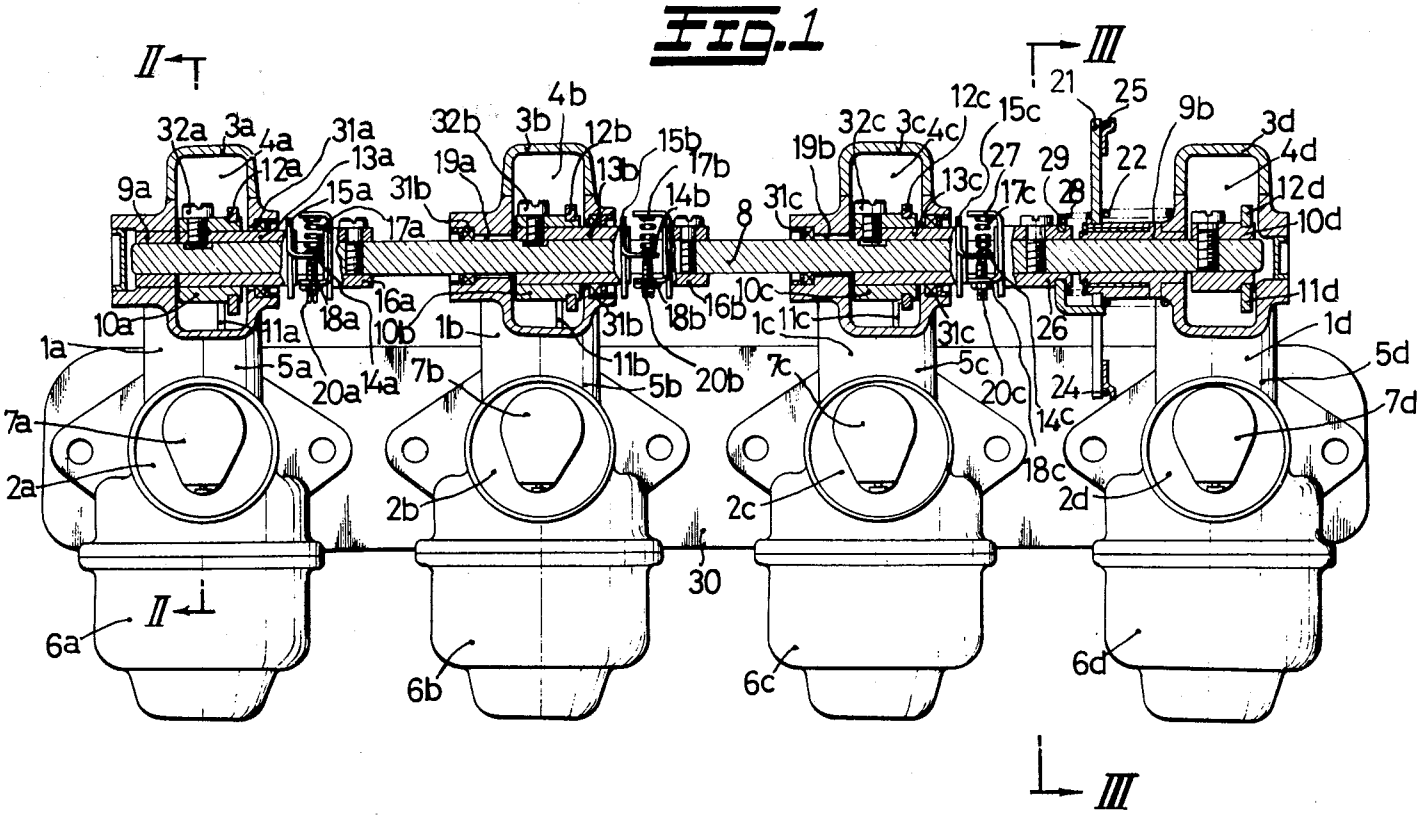
Figure 5:
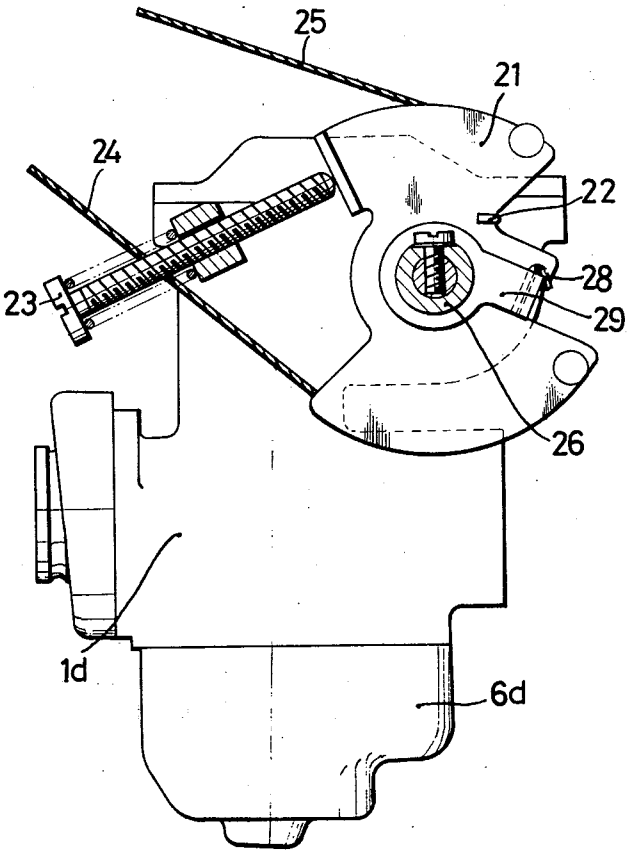
Figure 2:
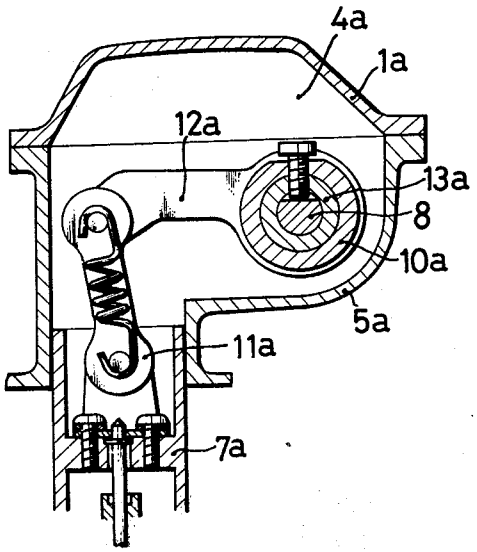

One embodying example of this invention will now be explained with reference to the accompanying drawings, wherein FIG. 1 is a front view, partly in section, of one example of this invention apparatus, FIG. 2 is a sectional view taken along line II — II in FIG. 1 and FIG. 3 is an elevational side view of a pulley type throttle operation member.

The illustrated embodiment is a four carburetor arrangement used for a four cylinder engine, and comprises a first carburetor 1*a*, a second carburetor 1*b*, a third carburetor 1*c* and a fourth carburetor 1*d* disposed side by side at regular intervals. These carburetors 1*a*1*b*,1*c*, 1*d* comprise carburetor bodies 5*a*,5*b*,5*c*,5*d* having machine casings 4*a*,4*b*,4*c*, 4*d*, composed of intake passages 2*a*,2*b*,2*c*,2*d* and covers 3*a*,3*b*,3*c*,3*d*, float chambers 6*a*,6*b*,6*c*,6*d* containing fuel therein and piston type throttle valves 7*a*,7*b*,7*c*7*d* for controlling the degree of opening of the foregoing intake passages 2*a*,2*b*,2*c*,2*d*.

Numeral 8 denotes a drum shaft comprising a single shaft which passes through the respective carburetors 1*a*,1*b*,1*c*,1*d* and is rotatably and tightly supported at its both ends by bearing portions 9*a*,9*b* of the carburetor body 5*a* of the first carburetor 1*a* and the carburetor body 5*d* of the fourth carburetor 1*d*, and numerals 10*a*,10*b*,10*c*,10*d* denote throttle shafts formed of hollow shafts which are connected, within the respective machine casings 4*a*,4*b*,4*c*,4*d* of the respective carburetors 1*a*,1*b*,1*c*,1*d*, to the respective piston type throttle valves 7*a*,7*b*,7*c*,7*d* through links 11*a*,11*b*,11*c*,11*d* and throttle levers 12*a*,12*b*,12*c*,12*d*. Numerals 13*a*,13*b*,13*c* denote adjusting shafts comprising inside the machine casings 4*a*,4*b*,4*c* of the first to third carburetors 1*a*,1*b*,1*c*, shaft portions formed of hollow shafts, and outside respective machine casings, adjusting lever portions 15*a*,15*b*,15*c*, having L-shaped tongue member portions 14*a*,14*b*,14*c*. Numerals 16*a*,16*b* denote accordance shafts secured to the drum shaft 8 and carrying channel-shaped tongue member portions which clamp the foregoing tongue member portions 14*a*,14*b* through springs 17*a*,17*b* and adjusting screws 18*a*,18*b*. Numerals 19*a*,19*b* denote through openings made in the second and the third carburetors 1*b*,1*c* for inserting the drum shaft 8 therethrough and these openings 19*a*,19*b* are designed to have somewhat larger diameters than the diameter of the drum shaft 8.

Numerals 20*a*,20*b* denote fastening nuts for positioning, for accordance, numeral 21 denotes a pulley-type throttle valve operation member which is rotatably mounted on the drum shaft 8 and is urged by a spring 22 toward the full closing position of the piston-type throttle valves, numeral 23 denotes an idle adjusting screw which is disposed to face a portion of the foregoing throttle valve operation member 21 for regulating the minimum idling open degrees of the respective throttle valves, numeral 24 denotes an operation cable for opening the valve, and the cable is in engagement at one end with the throttle valve operation member 21 and at its other end with an acceleration grip or pedal (not illustrated), and numeral 25 denotes an operation cable for closing the valve, and the cable 25 is in engagement at one end with the throttle valve operation member 21 and at its other end with the acceleration pedal.

Numeral 26 denotes a turning operation shaft which has at one end a channel-shaped tongue member portion 27 clamping the foregoing tongue member portion 14*c* of the third carburetor 1*c* through a spring 17*c*, an adjusting screw 18*c* and a fastening nut 20*c* and the shaft 26 has at its other end a turning lever portion 29 in engagement with the foregoing throttle valve operation member 21 and urged by a spring 28 toward the opening position of the throttle valves and the shaft 26 is secured to the drum shaft 8 by means of a fastening screw.

Numeral 30 denotes a supporting plate for installing thereon the respective carburetors disposed side by side, and numerals 31*a*,31*b*, and 31*c* denote sealing members for tightly closing the machine casings 4*a*,4*b*,4*c* of the respective carburetors 1*a*1,*b*,1*c*.

The adjusting shafts 13*a*,13*b*,13*c* and the throttle shafts 10*a*,10*b*,10*c* provided in the first to the third carburetors 1*a*,1*b*, 1*c* are arranged to be respectively fixed together integrally by means of fastening screws 32*a*,32*b*,32*c* and be rotatable in relation to the drum shaft 8.

This apparatus having the above construction can be assembled as follows:

After the respective carburetors 1*a*,1*b*,1*c*,1*d* are disposed on the supporting plate 30 at predetermined intervals, the first carburetor 1*a*, the second carburetor 1*b* and the third carburetor 1*c* are provided with the throttle shafts 10*a*,10*b*,10*c* and the adjusting shafts 13*a*,13*b*,13*c* fastened together by means of the fastening screws 32*a*,32*b*,32*c* and also the fourth carburetor 1*d* is provided with the throttle shaft 10*d*, the pulley-type throttle valve operation member 21 and other parts. Additionally, the accordance shaft 16*a* is provided corresponding with the adjusting lever portion 15*a* of the first carburetor 1*a*, the accordance shaft 16*b* is provided corresponding with the adjusting lever portion 15*b* of the second carburetor 1*b*, and the turning operation shaft 26 is provided corresponding with the adjusting lever portion 15*c* of the third carburetor 1*c* and the throttle valve operation member 21.

These constructional parts are disposed to be mounted on the drum shaft 8 inserted through the respective carburetors, and thereafter the accordance shafts 16*a*,16*b*, the turning operation shaft 26 and the throttle shaft 10*d* are secured to the drum shaft 8 by means of the respective fastening screws.

Next, after the constructional parts are thus assembled, the first carburetor 1*a* and the fourth carburetor 1*d* disposed at the extreme ends of the supporting plate 30 are fixed by fastening in such a condition that the centers of the bearing portions 9*a*,9*b* are in alignment with one another, so that the drum shaft 8 can be turned smoothly, and thereafter the second carburetor 1*b* and the third carburetor 1*c* are fixed by fastening.

In this case, the through opening 19*a*,19*b* made in the second carburetor 1*b* and the third carburetor 1*c* for inserting the drum shaft 8 therethrough are designed to be somewhat larger in diameter than the drum shaft 8 as mentioned before, so that the positioning and fixing operation for the second and the third carburetors 1*b*,1*c* can be done very simply and in a short time, without hampering the smooth turning of the drum shaft 8.

In the above embodiment, the bearing portions 9*a*,9*b* for the drum shaft 8 are provided on the first and fourth carburetors 1*a*,1*d* positioned at the extreme ends, but it can be so modified that these bearing portions 9*a*,9*b* may be provided on the second and third carburetors 1*b*,1*c*. The gaps between the drum shaft 8 and the through openings 19*a*,19*b* may be tightly sealed by the sealing member 31, so that no problems arise.

In accordance work for according the open degrees of the throttle valves 7*a*,7*b*,7*c*,7*d*, the pulley type operation member 21 is in a first step, adjusted by means of the idle adjusting screw 23 on the fourth carburetor 1*d* and thereby the idling open degree of the fourth carburetor 1*d* in set. Thereafter, the adjusting lever portions 15*a*,15*b* of the adjusting shafts 13*a*,13*b* are operated for adjustment by means of the adjusting screws 18*a*, 18*b* provided on the synchronizing shafts 16*a*,16*b* and thereby the idling open degrees of the first and second carburetors 1*a*,1*b* are set. Then, the adjusting lever portion 15*c* of the adjusting shaft 13*c* is operated for adjustment by means of the adjusting screw 19*c* provided on the turning and synchronizing operation shaft 26 and thereby the idling open degree of the third carburetor 1*c* is set.

Thus, according to this invention, the drum shaft comprising the single shaft for opening and closing control of throttle valve open degrees in a multi-carburetor arrangement is supported by two bearing portions provided on carburetors in the multi-carburetor arrangement and the remainder remaining carburetors are not provided with bearing action, so that on assembling of the carburetor, the drum shaft can be assembled very simply and in a short time and a favorable turning of the drum shaft can be obtained, and also there is not required any extremely high accuracy in an alignment of the through openings in the carburetor bodies, in the side by side arrangement of the adjacent carburetors, attaching openings in the supporting plate, and others, and thus it is extremely advantageous in working and assembling efficiences. Additionally, the accordance mechanism for the carburetors is disposed outside the carburetor bodies, so that an according operation can be effected extremely simply from the exterior, without detaching the carburetor bodies, and this is remarkably advantageous in practical use.

What is claimed is:

1. Apparatus for the opening and closing control of a plurality of carburetors each having a respective casing containing a throttle valve, said apparatus comprising a simple drum shaft extending in the casings of the plurality of carburetors and rotatable therein, a single common valve operation member coupled to said drum shaft for turning the same, a plurality of throttle shafts mounted on said drum shaft in respective casings, means connecting each of said throttle shafts to the respective throttle valve in the associated carburetor for operating the throttle valve upon turning of the drum shaft, and two bearing members in two of said carburetors rotatably supporting said drum shaft.

2. Apparatus as claimed in claim 1 comprising an idle speed adjustment means for acting on said common valve operation members to regulate the degree of opening of the throttle valves during idle.

3. Apparatus as claimed in claim 1 comprising a common support means for mounting of said casings of the carburetor in spaced intervals.

4. Apparatus as claimed in claim 1 comprising means operatively coupling said common valve operation member to one of said throttle shafts, and connection means operatively and adjustably connecting each of the other throttle shafts to said drum shaft.

5. Apparatus as claimed in claim 4 wherein said connection means is disposed externally of the respective casing of the associated carburetor.

6. Apparatus as claimed in claim 5 wherein said connection means includes an adjustable means for angularly adjusting the relative position of the throttle shaft and the drum shaft.

7. Apparatus as claimed in claim 6 wherein said connection means further includes an adjustment shaft mounted on said drum shaft and coupled with said throttle shaft.

8. Apparatus as claimed in claim 1 wherein said carburetors are at least four in number and are mounted in side by side relation, the carburetor casings without the bearings having bores receiving the drum shaft which are somewhat larger to permit free rotation.

9. Apparatus as claimed in claim 8 wherein the first and last carburetors are provided with said bearings.

* * * * *